US009491536B2

(12) United States Patent
Nageno et al.

(10) Patent No.: US 9,491,536 B2
(45) Date of Patent: Nov. 8, 2016

(54) HEADPHONE DRIVER, LOUDSPEAKER, AND METHOD OF MANUFACTURING HEADPHONE DRIVER OR LOUDSPEAKER

(71) Applicant: Sony Corporation, Tokyo (JP)

(72) Inventors: Koji Nageno, Tokyo (JP); Takeshi Hara, Kanagawa (JP)

(73) Assignee: Sony Corporation, Tokyo (JP)

( * ) Notice: Subject to any disclaimer, the term of this patent is extended or adjusted under 35 U.S.C. 154(b) by 184 days.

(21) Appl. No.: 14/372,360

(22) PCT Filed: Jan. 17, 2013

(86) PCT No.: PCT/JP2013/050773

§ 371 (c)(1),
(2) Date: Jul. 15, 2014

(87) PCT Pub. No.: WO2013/140839

PCT Pub. Date: Sep. 26, 2013

(65) Prior Publication Data

US 2014/0363013 A1 Dec. 11, 2014

(30) Foreign Application Priority Data

Mar. 19, 2012 (JP) ..... 2012-061835

(51) Int. Cl.

| | |
|---|---|
| ***H04R 1/10*** | (2006.01) |
| ***H04R 5/033*** | (2006.01) |
| ***H04R 3/00*** | (2006.01) |
| ***H04R 9/02*** | (2006.01) |

(52) U.S. Cl.

CPC ..... *H04R 1/1091* (2013.01); *H04R 3/00* (2013.01); *H04R 5/033* (2013.01); *H04R 9/025* (2013.01); *H04R 2209/024* (2013.01)

(58) Field of Classification Search

CPC .... H04R 5/033; H04R 9/025; H04R 1/1091; H04R 3/00; H04R 2209/024

USPC ..... 381/177, 420, 190, 396, 412, 414

See application file for complete search history.

(56) References Cited

U.S. PATENT DOCUMENTS

2009/0296979 A1* 12/2009 Kamimura ..... H04R 9/06 381/412

OTHER PUBLICATIONS

International Search Report; International Application No. PCT/JP2013/050773: Date of completion of Search: Jan. 31, 2013. (Form PCT/ISA/210).

Written Opinion of the International Searching Authority; International Application No. PCT/JP2013/050773; Date of Written Opinion: Feb. 12, 2013. (Form PCT/ISA/237).

* cited by examiner

*Primary Examiner* — David Ton

(74) *Attorney, Agent, or Firm* — Chip Law Group

(57) ABSTRACT

Provided is a headphone driver including a yoke that has a bottom surface and an erected surface that is erected in a perpendicular direction with respect to the bottom surface, and that is formed using a magnetic material, and a bonded magnet unit consisting of a bonded magnet that is provided on the bottom surface of the yoke. The magnetic flux of the bonded magnet unit is concentrated on the side surface of the bonded magnet unit facing the erected surface of the yoke.

9 Claims, 12 Drawing Sheets

HEADPHONE DRIVER, LOUDSPEAKER, AND METHOD OF MANUFACTURING HEADPHONE DRIVER OR LOUDSPEAKER

TECHNICAL FIELD

The present invention relates to a headphone driver, a loudspeaker, and a method of manufacturing a headphone driver or a loudspeaker.

BACKGROUND ART

A magnet (permanent magnet) is used as a component for producing a drive force for causing a diaphragm (vibrating plate) to vibrate in a dynamic headphone driver (also called a driver unit) or a loudspeaker. As this kind of permanent magnet, those manufactured by sintering a magnetic body are generally used.

On the other hand, development is underway of so-called bonded magnets that are obtained by molding rare-earth magnetic power such as neodymium (Nd) or ferrite particles using a thermoplastic resin such as a polyamide resin as a binder (for example, refer to Patent Literature 1 below).

CITATION LIST

Patent Literature

Patent Literature 1: JP 2007-35667A

SUMMARY OF INVENTION

Technical Problem

However, with regard to using a bonded magnet such as disclosed in the aforementioned Patent Literature 1 in a dynamic headphone driver or loudspeaker, since it is not possible to achieve sufficient magnetic flux compared to a conventional sinter-molded magnet, application to a headphone driver or loudspeaker has not been possible.

Therefore, in view of the aforementioned circumstances, the present disclosure provides a headphone driver and a loudspeaker that use a bonded magnet, and a method of manufacturing a headphone driver or a loudspeaker.

Solution to Problem

According to the present disclosure, there is provided a headphone driver including a yoke that has a bottom surface and an erected surface that is erected in a perpendicular direction with respect to the bottom surface, and that is formed using a magnetic material, and a bonded magnet unit consisting of a bonded magnet that is provided on the bottom surface of the yoke. The magnetic flux of the bonded magnet unit is concentrated on the side surface of the bonded magnet unit facing the erected surface of the yoke.

According to the present disclosure, there is provided a loudspeaker including a yoke that has a bottom surface and an erected surface that is erected in a perpendicular direction with respect to the bottom surface, and that is formed using a magnetic material, and a bonded magnet unit consisting of a bonded magnet that is provided on the bottom surface of the yoke. The magnetic flux of the bonded magnet unit is concentrated on the side surface of the bonded magnet unit facing the erected surface of the yoke.

According to the present disclosure, there is provided a method of manufacturing a headphone driver or a loudspeaker, the method including performing orientation control of a bonded magnet with a magnetic field molding apparatus and a mold to manufacture a bonded magnet unit. Portions of the mold corresponding to the top surface and the bottom surface of the bonded magnet unit are formed with a magnetic material. Among portions of the mold corresponding to the outer side surface of the bonded magnet unit, approximately half on a side of the top surface in the height direction is formed with a magnetic material, and approximately half on a side of the bottom surface in the height direction is formed with a non-magnetic material.

Advantageous Effects of Invention

According to the present disclosure as described above, it is possible to provide a headphone driver and a loudspeaker that use a bonded magnet.

DESCRIPTION OF EMBODIMENTS

Hereinafter, preferred embodiments of the present invention will be described in detail with reference to the appended drawings. Note that, in this specification and the drawings, elements that have substantially the same function and structure are denoted with the same reference signs, and repeated explanation is omitted.

The description shall be carried out in the following order:

(1) Constitution of Headphones (2) First Embodiment (2-1) Constitution of Headphone Driver (2-2) Constitution of Loudspeaker (2-3) Method of Manufacturing Headphone Driver or Loudspeaker (3) Practical Embodiments

Constitution of Headphones

Figure 1:
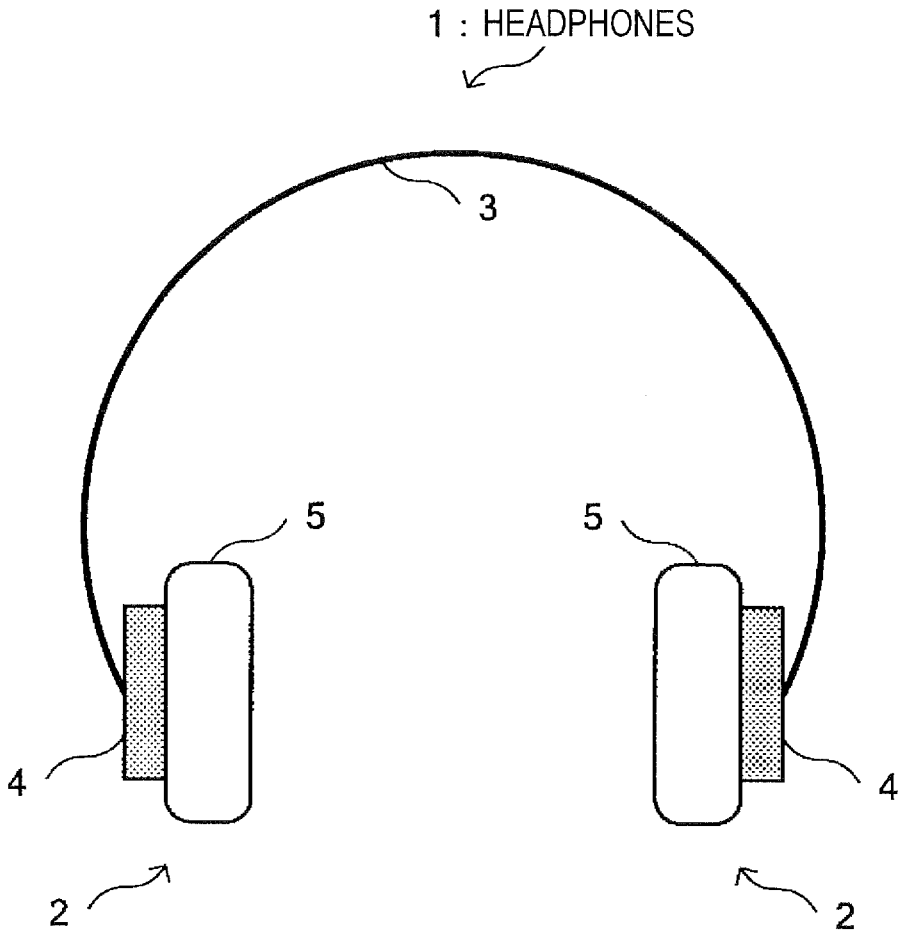
FIG. 1 is an explanatory drawing that schematically shows the constitution of common headphones.

Prior to describing a headphone driver, loudspeaker, and a method of manufacturing a headphone driver or a loudspeaker according to an embodiment of the present disclosure, the constitution of common headphones shall be described below while referring to FIG. 1 and FIG. 2. FIG. 1 is an explanatory drawing that schematically shows the constitution of common headphones, while FIG. 2 is an explanatory drawing that shows an example of the constitution of a common headphone driver.

FIG. 1 is a front view that roughly shows so-called overhead headphones that are generally used. As shown in FIG. 1, common headphones 1 are provided with a pair of headphone main bodies 2 and a headband 3. Also, a housing 4 and an ear pad 5 full of flexibility that is attached to this housing 4 are provided in each headphone main body 2.

By the headband 3 being mounted on the user's head, and the ear pads 5 being abutted against the side head portions or ears of the user, the user is able to perceive sound that is converted from electrical signals by a headphone driver (not illustrated) provided inside each housing 4.

Figure 2:
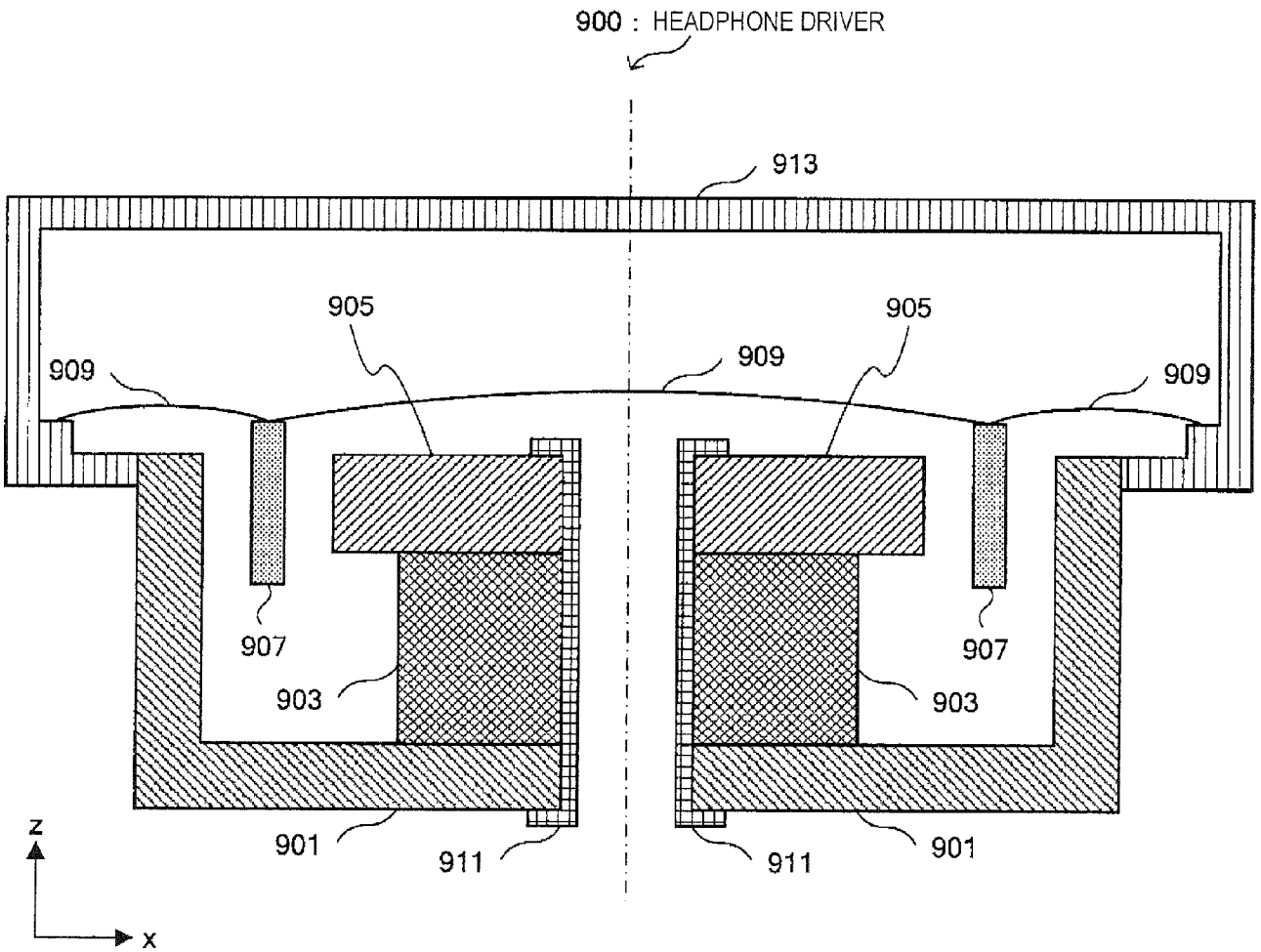
FIG. 2 is an explanatory drawing that shows an example of the constitution of a common headphone driver.

FIG. 2 shows a cross-sectional drawing of a common dynamic headphone driver (also called a driver unit) 900 that is provided inside each housing 4. Note that the cross-sectional drawing that is shown in FIG. 2 is one that severs one housing 4 shown in FIG. 1 in a direction parallel with the page, so that the direction facing the user's ear is the Z-axis direction. The common headphone driver 900 has such a shape that it is rotationally symmetrical about the center axis that is parallel with the Z axis in FIG. 2

As shown in FIG. 2, the common headphone driver 900 is mainly provided with a yoke 901, a magnet 903, a pole piece 905, a voice coil 907, a diaphragm 909, a locking member 911, and a protector 913.

The yoke 901 is a component with an approximate cylindrical shape having a bottom surface and a side surface that is erected on the bottom surface, and is formed using a magnetic material, such as iron. A publicly known magnet 903 such as a magnet containing rare-earth particles such as neodymium, a ferrite magnet, or a cobalt magnet is provided on the bottom surface of the yoke 901. Also, the pole piece (also called a top plate) 905 that is formed using a magnetic material such as iron is provided on the top surface of the magnet 903.

Also, the voice coil 907 is provided in the gap that is positioned between the side surface of the yoke 901, and the magnet 903 and the pole piece 905. Due to an acoustic signal (acoustoelectric current) being impressed on the voice coil 907, and the magnetic field created by the magnet 903, a Lorentz force corresponding to the magnitude of the impressed acoustoelectric current is created.

The diaphragm (vibrating plate) 909 is provided on the voice coil 907. This diaphragm 909 vibrates by the Lorentz force produced in the voice coil 907. Thereby, the acoustoelectric current is converted to sound.

Also, the yoke 901, the magnet 903, and the pole piece 905 are mutually locked by the locking member 911 as shown in FIG. 2, and the diaphragm 909 is protected by the protector 913.

Also, this kind of dynamic headphone driver 900 is a mechanism that is incorporated not only in overhead headphones as shown in FIG. 1, but various kinds of publicly known headphones such as inner ear types, ear hooking types, and ear plug types. Also, a similar mechanism is implemented not only in headphones but also in loudspeakers.

In the common dynamic headphone driver 900 as shown in FIG. 2, a permanent magnet that is molded by sintering a rare-earth element such as neodymium is normally used for the magnet 903. By contrast, in recent years development has been progressing of a so-called bonded magnet that is formed by mixing magnetic power with a binder resin as described above. However, the magnetic flux of this kind of bonded magnet compared to a magnet that is molded by sintering a rare-earth element is low, and so its application to a dynamic headphone driver as described above has not been achieved.

As a result of diligent investigation into manufacturing a headphone driver and loudspeaker using a bonded magnet, the inventors discovered a method that enables development of nearly the same degree of magnetism as a common rare-earth magnet even when using a bonded magnet. Also, the inventors conceived of a headphone driver and loudspeaker that uses a bonded magnet as described below by utilizing this kind of method.

First Embodiment

Constitution of Headphone Driver

Hereinbelow, the constitution of a headphone driver according to the first embodiment of the present disclosure shall be described in detail, referring to FIG. 3A to FIG. 5C, taking headphones having the overall constitution as shown in FIG. 1 as an example. Needless to say, the headphone driver according to the present embodiment can be applied not only to overhead headphones as shown in FIG. 1, but also various kinds of publicly known headphones such as inner ear types, ear hooking types, and ear plug types.

Figure 3A:
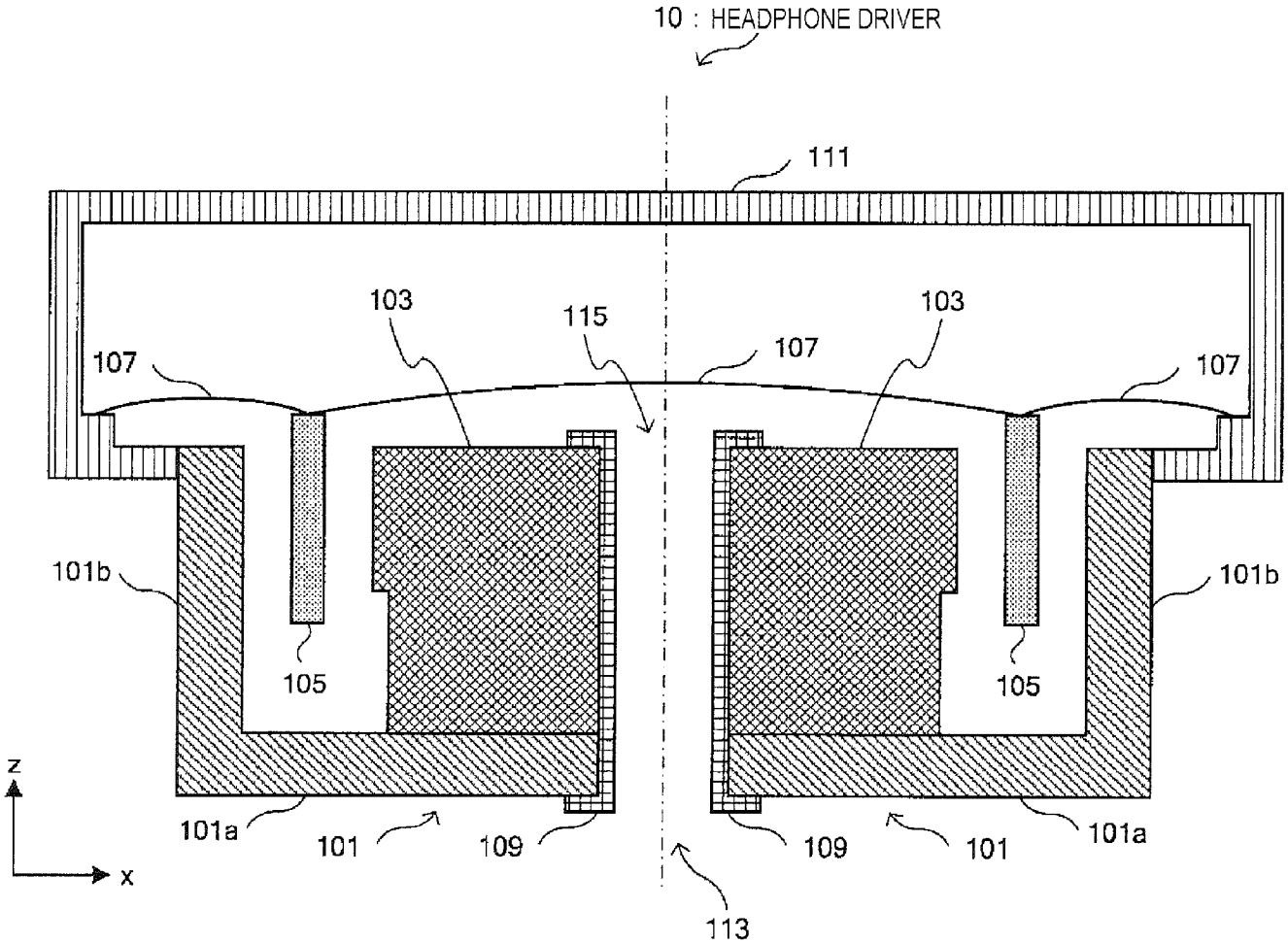
FIG. 3A is a cross-sectional drawing of an example of a headphone driver that headphones according to the first embodiment of the present disclosure have.
Figure 3B:
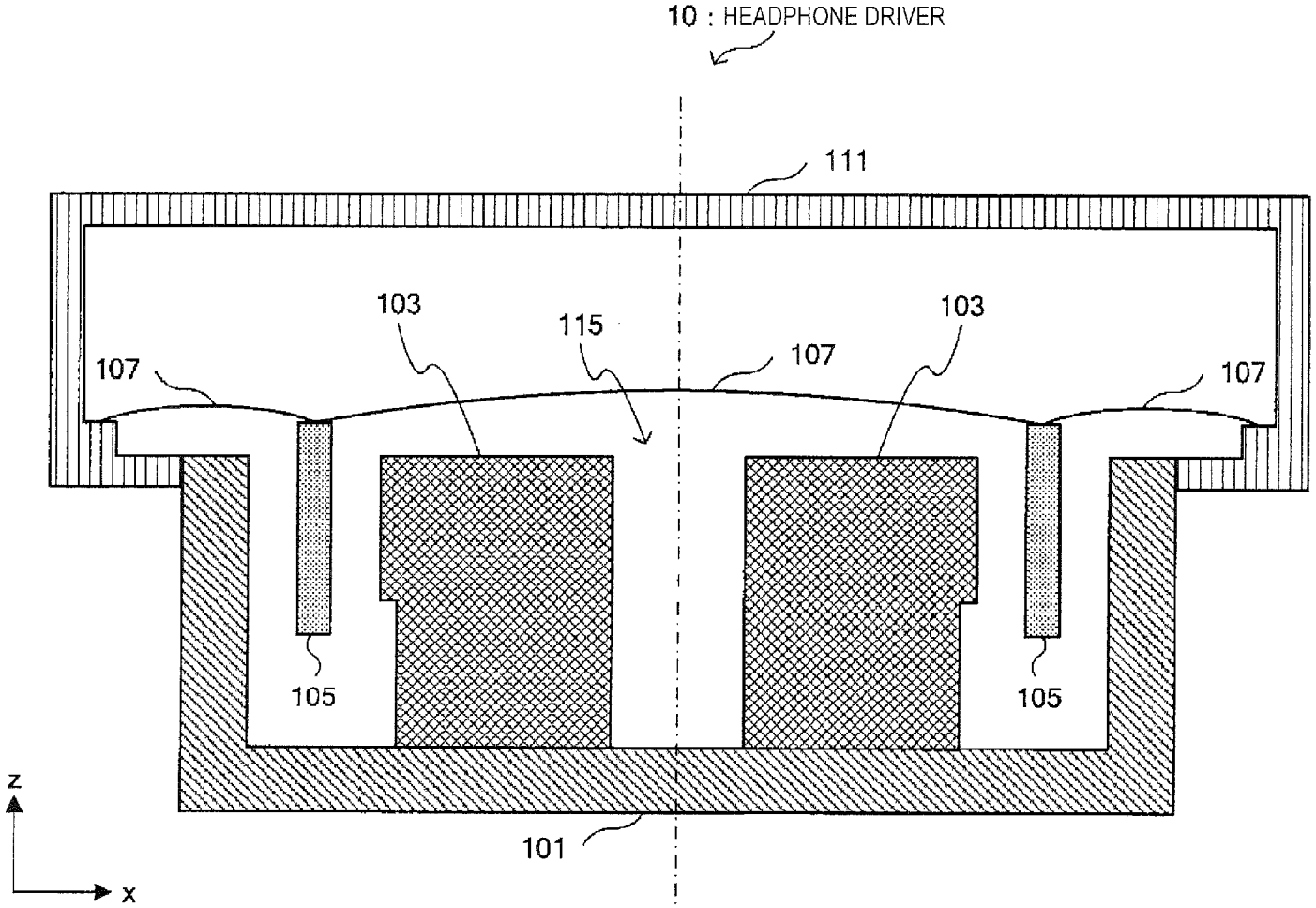
FIG. 3B is a cross-sectional drawing of an example of a headphone driver that headphones according to the same embodiment have.
Figure 3C:
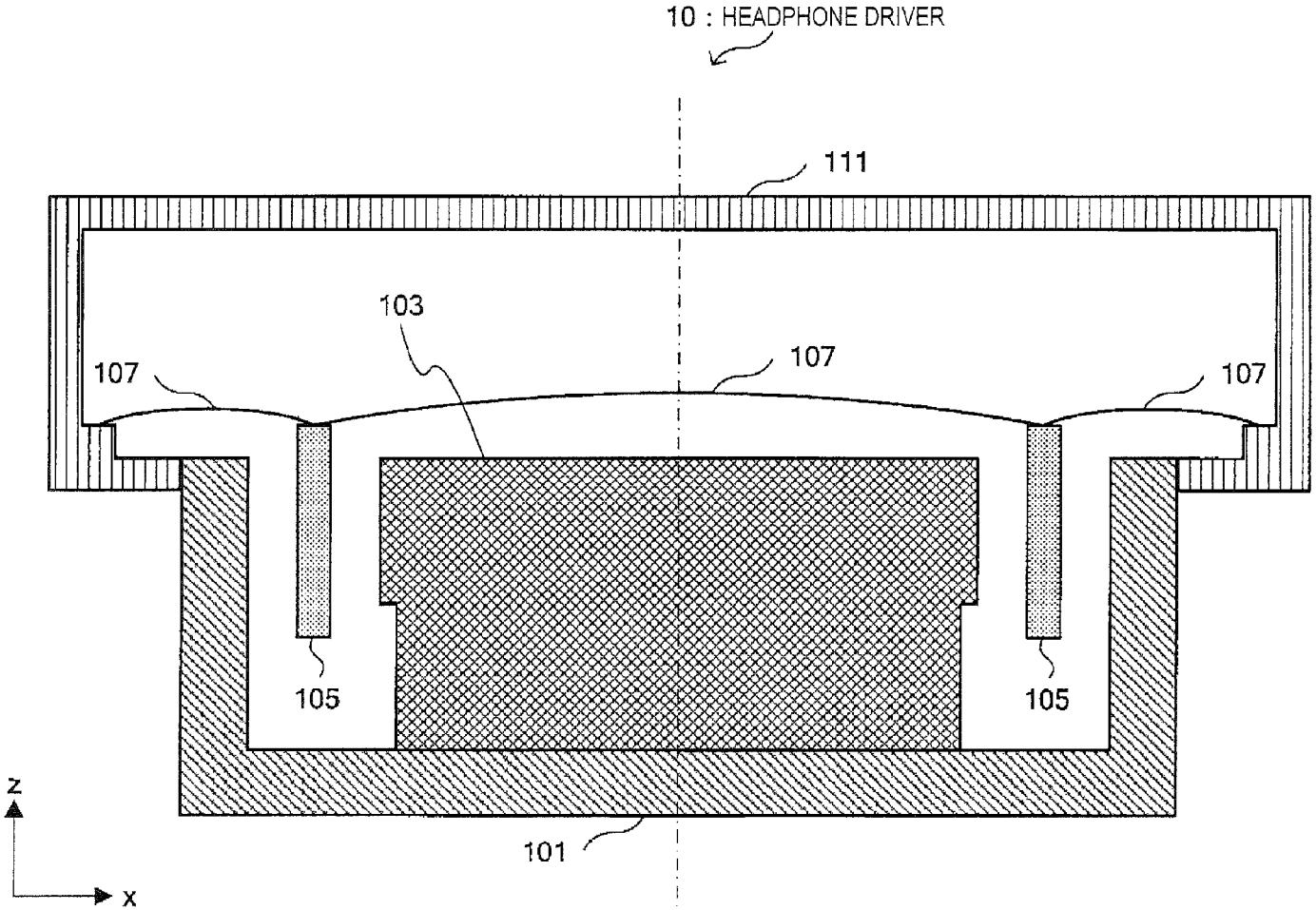
FIG. 3C is a cross-sectional drawing of an example of a headphone driver that headphones according to the same embodiment have.

FIG. 3A to FIG. 3C are cross-sectional drawings of examples of a dynamic headphone driver that headphones according to the present embodiment have. The cross-sectional views shown in FIG. 3A to FIG. 3C sever one housing 4 shown in FIG. 1 in a direction parallel with the page, so that the direction facing the user's ear is the Z-axis direction.

First, an example of a headphone driver according to the present embodiment shall be described in detail referring to FIG. 3A. A headphone driver 10 according to the present embodiment has such a shape that it is rotationally symmetrical about the center axis that is parallel with the Z axis in FIG. 3A.

As shown in FIG. 3A, the headphone driver 10 according to the present embodiment is mainly provided with a yoke 101, a bonded magnet unit 103, a voice coil 105, a diaphragm 107, a locking member 109, and a protector 111.

The yoke 101 is formed using a magnetic material such as iron. As shown in FIG. 3A, the yoke 101 is a component with an approximate cylindrical shape having a bottom surface 101*a* and a side surface 101*b* that is provided on this bottom surface 101*a*. Also, in the example shown in FIG. 3A, a through-hole 113 is provided at the approximate center region in the X direction of the yoke 101.

The bonded magnet unit 103, which is formed using a bonded magnet, is arranged on the bottom surface 101*a* of the yoke 101. The bonded magnet unit 103 resembles one in which the magnet and the pole piece in the common headphone driver are integrated, as is clear from a comparison of the structure of the common headphone driver shown in FIG. 2 and FIG. 3A.

The bonded magnet unit 103 is formed using a publicly known bonded magnet. The magnet that is used in the bonded magnet unit 103 is not limited, and examples can include a bonded magnet that contains a neodymium (Nd) component, a samarium (Sm) component, and a polyamide that is a binder. The blending ratio of the components should be suitably decided, and for example it is possible to use the following blending ratio:

Neodymium (Nd): 16 mass %
Iron-boron (Fe—B) alloy: 38 mass %
Samarium (Sm): 11 mass %
Iron-nitrogen (Fe—N) alloy: 25 mass %
Nylon: 10 mass %

For example, by adopting the abovementioned blending ratio, it is possible to keep down the proportion of costly rare-earth elements such as neodymium and samarium, and so it is possible to reduce the manufacturing cost of the bonded magnet unit 103.

The through-hole 115 is provided in the approximate center region of the bonded magnet unit 103 in the X direction. Moreover, as shown for example in FIG. 3A, the yoke 101 and the bonded magnet unit 103 are arranged so that the through-hole 113 provided in the yoke 101 and the through-hole 115 provided in the bonded magnet unit 103 are mutually concentric.

Also, the yoke 101 and the bonded magnet unit 103 are fixed to each other by the locking member 109.

In addition, the magnetic characteristics of this bonded magnet unit 103 are fully described below.

The voice coil 105 is arranged in the gap that exists between the side surface 101*b* of the yoke 101, and the side surface of the bonded magnet unit 103. As a result of an acoustoelectric current flowing in this voice coil 105, a Lorentz force is generated due to the magnetic field that exists between the side surface 101*b* of the yoke 101, and the bonded magnet unit 103.

The diaphragm (vibrating plate) 107 is connected to the voice coil 105. The diaphragm 107 vibrates by the Lorentz force produced in the voice coil 105 due to the acoustoelectric current, whereby the acoustoelectric current is converted to sound. Moreover, the diaphragm 107 is covered with the protector 111, thereby preventing damage to the diaphragm 107.

In the example shown in FIG. 3A, the description was given for the case of the through-hole being provided in both the yoke 101 and the bonded magnet unit 103, but the yoke 101 and the bonded magnet unit 103 according to the present disclosure are not necessarily limited to the abovementioned example. For example, as shown in FIG. 3B, the through-hole need not be formed in the yoke 101, and as shown in FIG. 3C, the through-hole need not be formed in both the yoke 101 and the bonded magnet unit 103.

Next, the bonded magnet unit 103 of the headphone driver 10 according to the present embodiment shall be described referring to FIG. 4A to FIG. 4D, focusing on its magnetic characteristics. FIG. 4A to FIG. 4D are explanatory drawings that schematically show a portion of the bonded magnet unit of the headphone driver according to the present embodiment. FIG. 4A to FIG. 4D illustrate a portion of the yoke 101, the bonded magnet unit 103, and the voice coil 105 in the headphone driver 10, which has rotational symmetry as shown in FIG. 3A.

In the magnet 903 that is provided in a common headphone driver 900 as shown in FIG. 2, the magnetic flux produced by the magnet is arranged to be approximately parallel with the Z-axis direction, heading toward the top surface of the magnet 903 (that is, the surface in contact with the pole piece 905). However, the orientation of the magnetic flux of the bonded magnet unit 103 of the headphone driver 10 according to the present embodiment is controlled as shown in FIG. 4A, to be concentrated more at a side surface 103*b* than a top surface 103*a* of the bonded magnet unit 103.

Figure 4A:
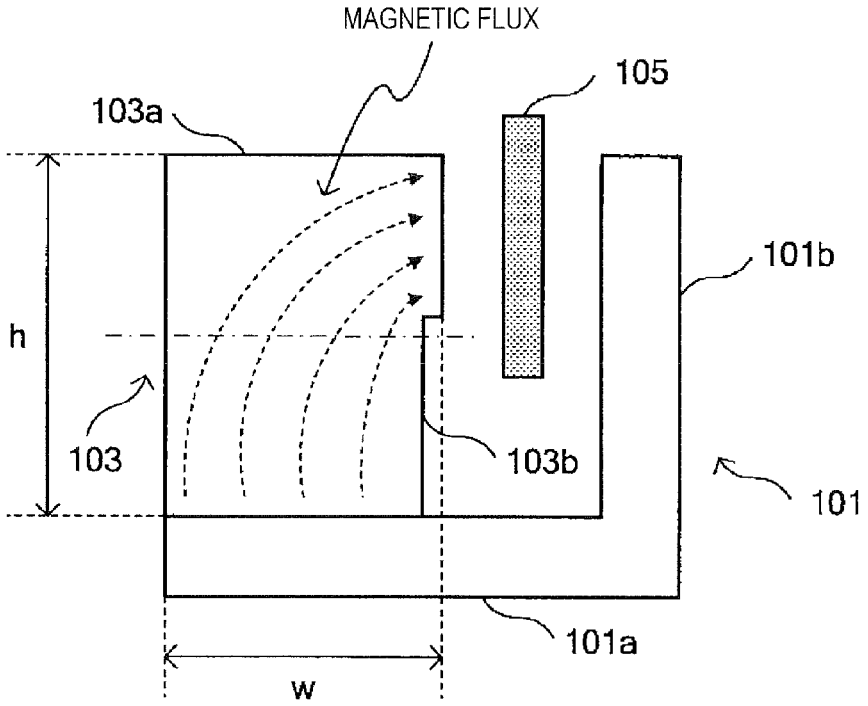
FIG. 4A is an explanatory drawing that schematically shows a portion of the bonded magnet unit according to the same embodiment.

In greater detail, as shown in FIG. 4A, the magnitude of the magnetic flux concentrated at the upper half portion in the height direction of the bonded magnet unit 103 is greater than the magnitude of the magnetic flux at the lower half portion in the height direction (Z-axis direction) of the bonded magnet unit 103 (the bottom surface 101*a* side of the yoke 101). That is to say, at the side surface 103*b* facing the side surface 101*b* of the yoke 101, the magnetic flux of the bonded magnet unit 103 can be described as being mostly concentrated at the portion facing the voice coil 105. By orienting the magnetic body constituting the bonded magnet so that its magnetic flux becomes thus, it is possible to realize a magnetic flux density nearly equivalent to that of a common neodymium sintered magnet, with the bonded magnet unit 103 according to the present embodiment.

In addition, in the cross section as shown in FIG. 4A, it is preferable that the height of the bonded magnet unit 103 be greater than one-half the width of the bonded magnet unit. That is to say, as shown for example in FIG. 4A, the height h of the bonded magnet unit 103 is preferably greater than one-half the width (the width w, in FIG. 4), with the aspect ratio (h:w) being 1:1 or greater. By the height of the bonded magnet unit 103 satisfying the aforementioned aspect ratio, the bonded magnet unit 103 comes to have a vertically long shape, as shown in FIG. 4A. As a result, it becomes easier to concentrate the magnetic flux at the upper-half portion of the bonded magnet unit 103.

The cross-sectional shape of the bonded magnet unit 103 according to the present embodiment is not necessarily limited to the shape in which a step is formed in the side surface 103*b*, as shown in FIG. 4A, and provided the magnetic flux is concentrated at the upper-half portion of the side surface 103*b*, it is possible to make it have any shape. For example, as shown in FIG. 4B, the cross-sectional shape of the bonded magnet unit 103 may also be a rectangular shape in which no step exists.

Figure 4B:
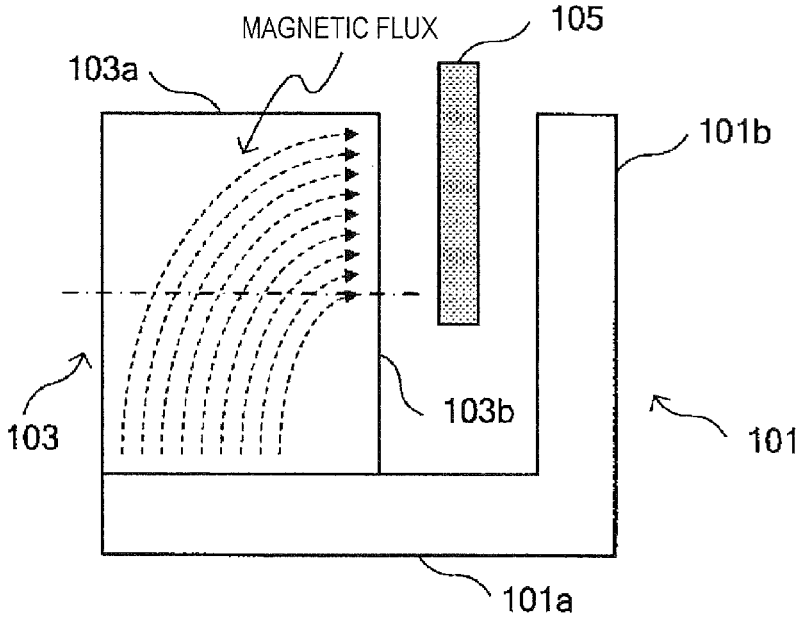
FIG. 4B is an explanatory drawing that schematically shows a portion of the bonded magnet unit according to the same embodiment.
Figure 4C:
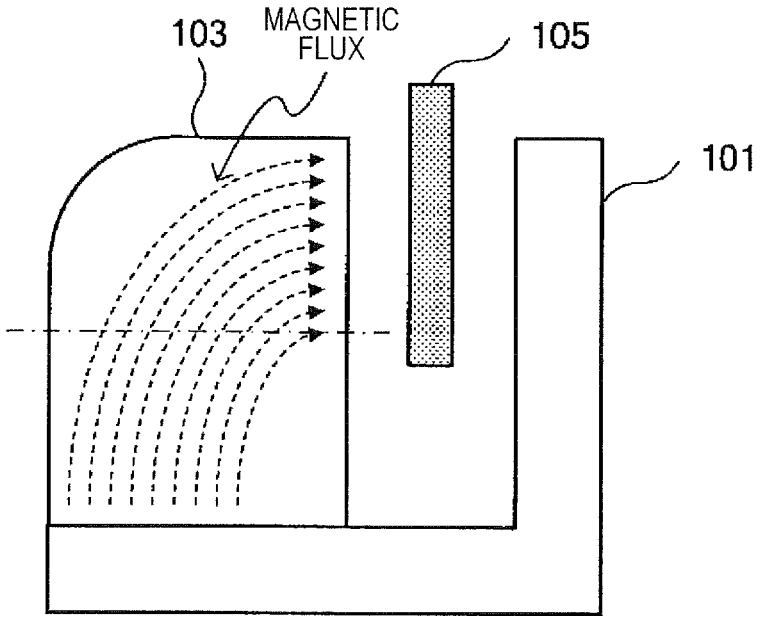
FIG. 4C is an explanatory drawing that schematically shows a portion of the bonded magnet unit according to the same embodiment.
Figure 4D:
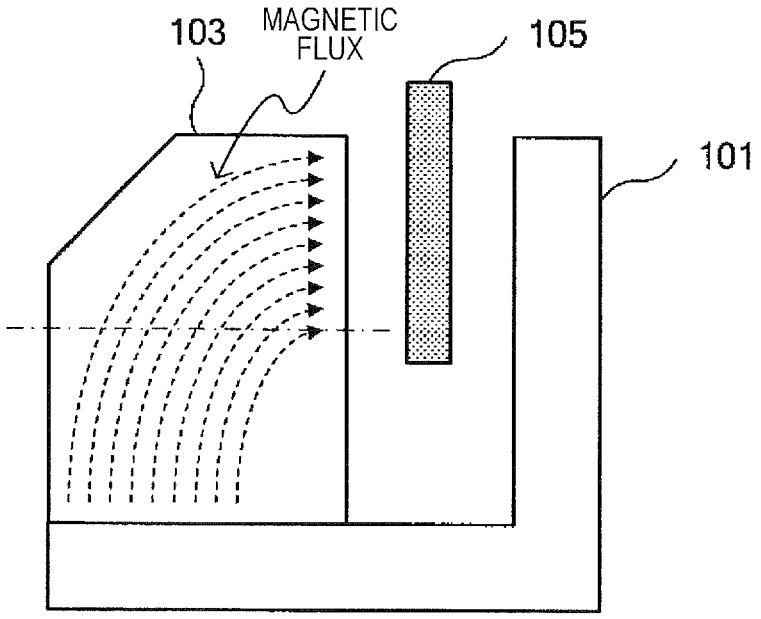
FIG. 4D is an explanatory drawing that schematically shows a portion of the bonded magnet unit according to the same embodiment.

Also, as a result of the orientation of the magnetic flux of the bonded magnet unit 103 according to the present embodiment being controlled, the magnetic flux curves toward the voice coil 105 as shown in FIG. 4A and FIG. 4B, so the end portion of the side surface not facing the voice coil 105 need not be angulated. Therefore, that end portion may be made to have an R shape as shown for example in FIG. 4C, and may be a notched portion as shown in FIG. 4D.

The bonded magnet unit 103 was described in detail above, centered on its magnetic characteristics, while referring to FIG. 4A to FIG. 4D.

Figure 5A:
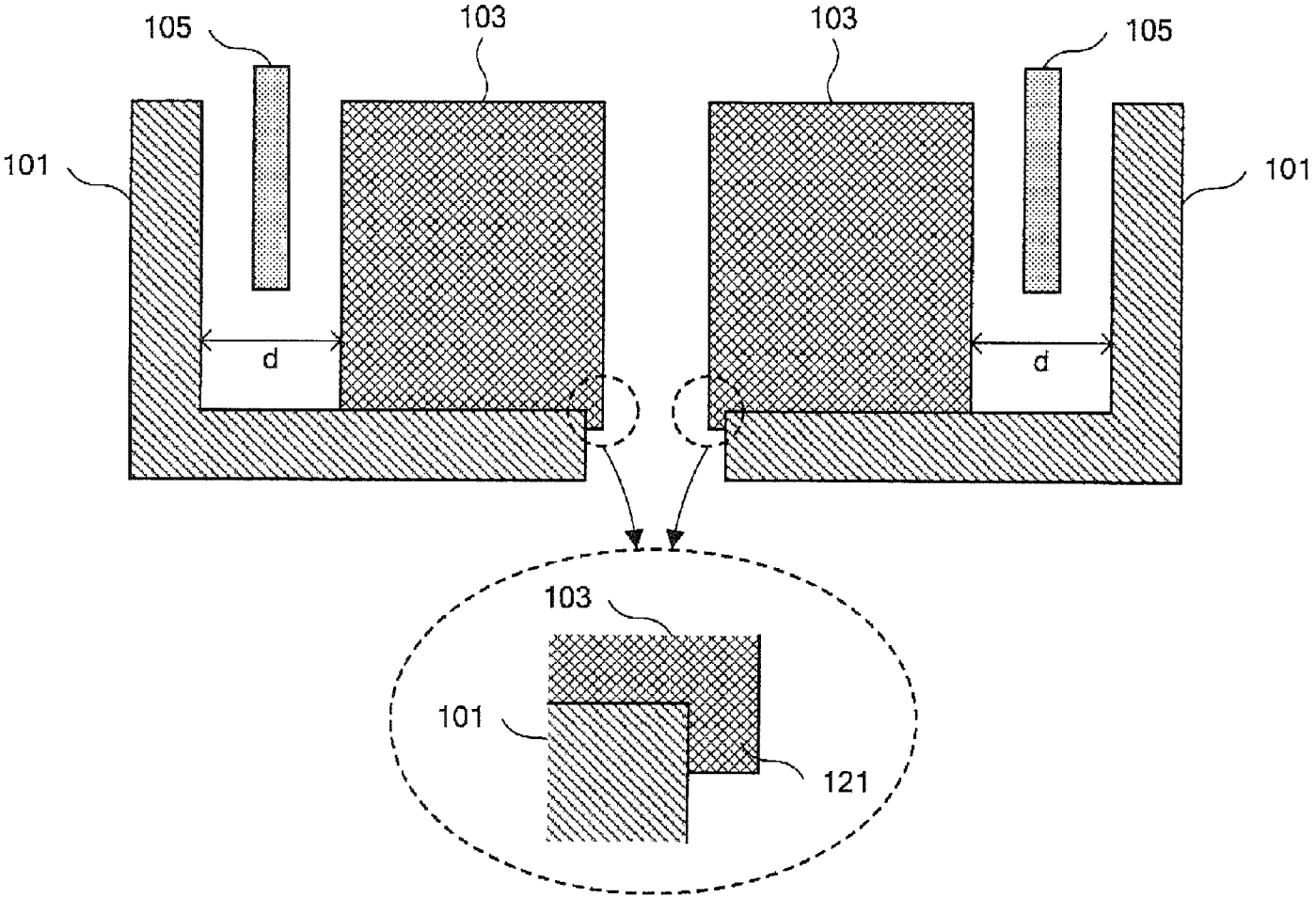
FIG. 5A is an explanatory drawing that shows an example of the bonded magnet unit according to the same embodiment.
Figure 5B:
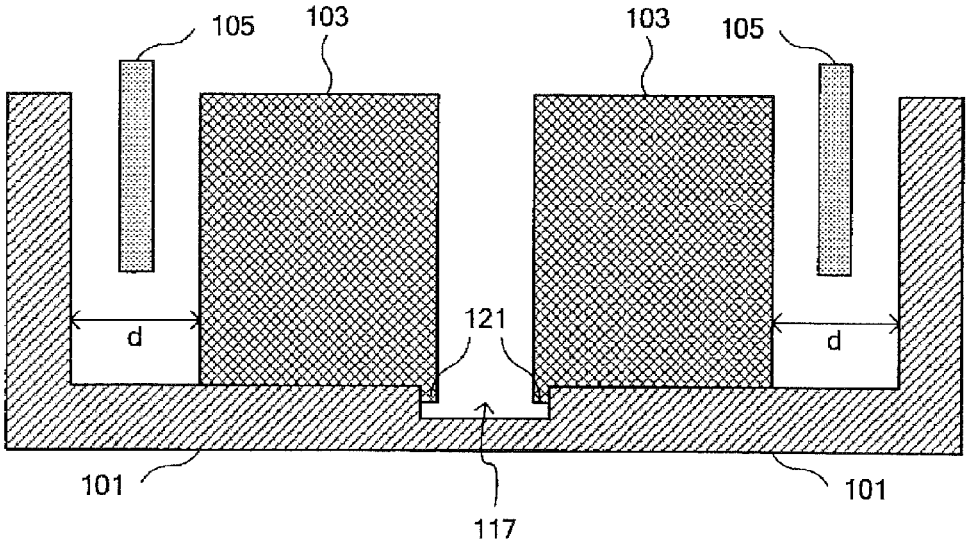
FIG. 5B is an explanatory drawing that shows an example of the bonded magnet unit according to the same embodiment.
Figure 5C:
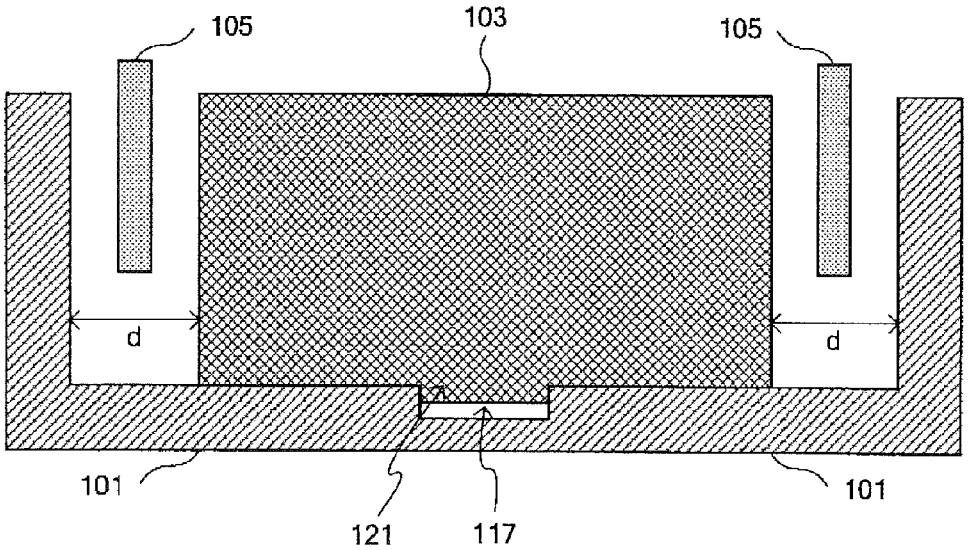
FIG. 5C is an explanatory drawing that shows an example of the bonded magnet unit according to the same embodiment.

FIG. 5A to FIG. 5C are explanatory drawings that show an example of a bonded magnet unit of the headphone driver according to the present embodiment. In the manufacture of the headphone driver, it is preferable to be able to easily determine the arrangement position of the bonded magnet unit 103 with respect to the bottom surface 101*a* of the yoke 101, to make the size of the gap between the side surface 101*b* of the yoke 101 and the side surface 103*b* of the bonded magnet unit 103 constant. Therefore, as shown for example in FIG. 5A, a projecting portion 121 provided at the bottom surface of the bonded magnet unit 103, and the projecting portion 121 can be made to abut the side surface of the yoke 101.

In the example shown in FIG. 5A, the projecting portion 121 of the bonded magnet unit 103 is provided so as to abut the side surface of the through-hole that is provided in the yoke 101. By providing this kind of projecting portion 121, it is possible to make constant the separation distance d between the side surface 101*b* of the yoke 101 and the side surface 103*b* of the bonded magnet unit 103, and it is possible to improve the installation accuracy of the bonded magnet unit 103.

Also, the relation between the yoke 101 and the projection portion 121 is not necessarily limited to the example shown in FIG. 5A. For example, in FIG. 5B, a concave portion 117 is provided in the approximate center portion of the bottom surface of the yoke 101, and a projecting portion 121 is formed on the bonded magnet unit 103 so as to abut the side surface of this concave portion 117. Also, for example in FIG. 5C, a projecting portion 121 is formed at a position corresponding to the concave portion 117 that is provided in the yoke 101, on the bottom surface of the bonded magnet unit 103 where the through-hole does not exist, and by the insertion of the projecting portion 121 in the concave portion 117, the projecting portion 121 abuts the concave portion 117.

The headphone driver 10 according to the present embodiment was described in detail above while referring to FIG. 3A to FIG. 5C.

Constitution of Loudspeaker

Figure 6:
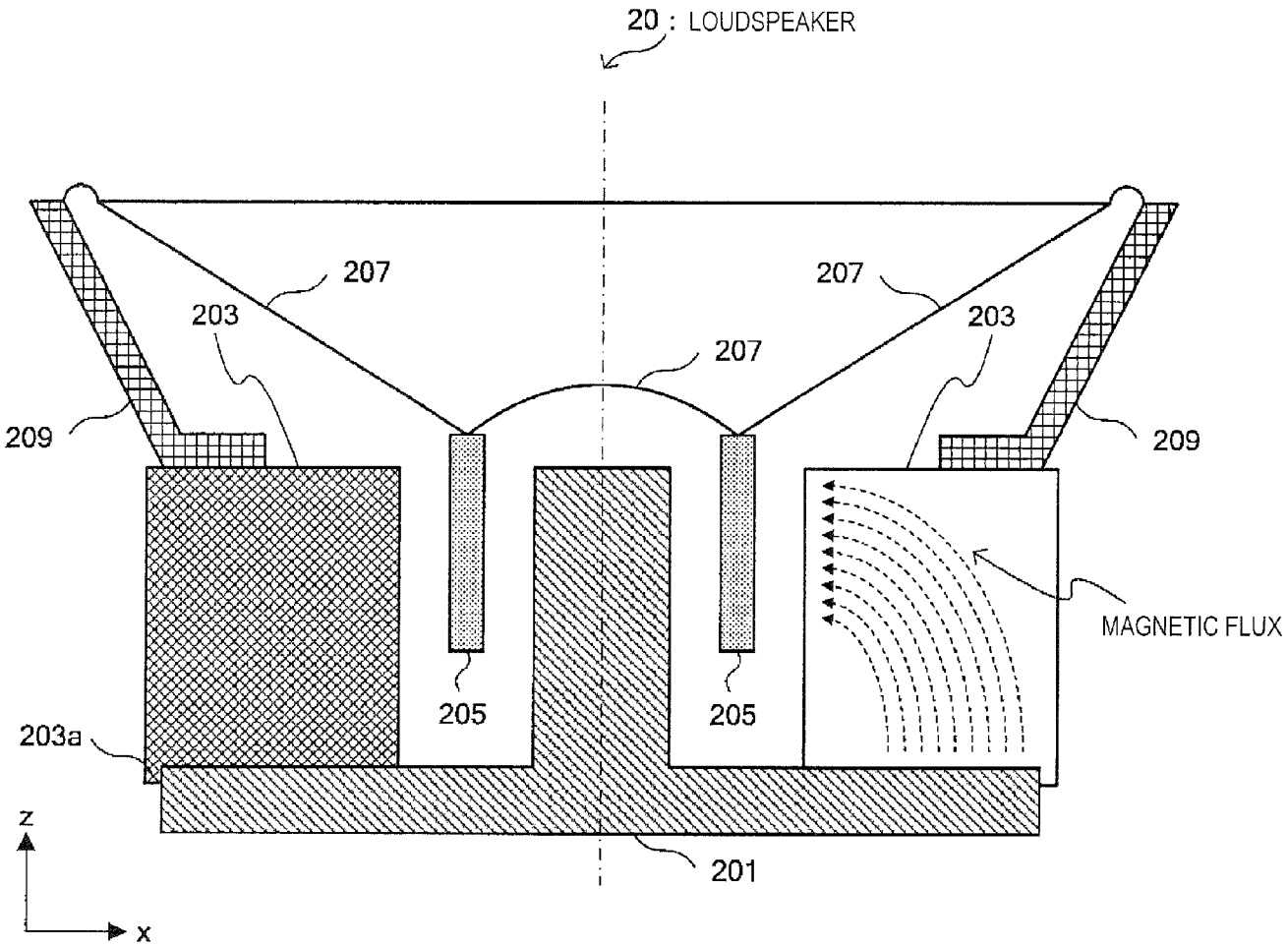
FIG. 6 is a cross-sectional drawing of an example of a loudspeaker according to the same embodiment.

Next, referring to FIG. 6, the constitution of a loudspeaker according to the present embodiment shall be briefly described, referring to FIG. 6. FIG. 6 is an explanatory drawing showing the constitution of a loudspeaker 20 according to the present embodiment. The loudspeaker 20 according to the present embodiment has a shape that is rotationally symmetrical about the center axis that is parallel with the Z axis in FIG. 6.

The loudspeaker 20 according to the present embodiment is mainly provided with a yoke 201, a bonded magnet unit 203 in which a through-hole is provided in the approximate center, a voice coil 205, a diaphragm (vibrating plate) 207, and a housing 209, as shown for example in FIG. 6.

As shown in FIG. 6, the yoke 201 is a component with an approximate reversed T shape that is formed using a magnetic material such as iron, having a bottom surface and an erected surface that is erected from the bottom surface. Also, the bonded magnet unit 203 is provided on the bottom surface of the yoke 201, and a gap is produced between the side surface of the bonded magnet unit 203 and the erected surface of the yoke 201. A voice coil 205 is provided in the gap between the erected surface of the yoke 201 and the side surface of the bonded magnet unit 203.

Here, the orientation of the magnetic flux of the bonded magnet unit 203 of the loudspeaker 20 according to the present embodiment is controlled so as to curve toward the voice coil 205, in the same manner as the bonded magnet unit 103 of the headphone driver 10 previously described. In addition, with regard to the method of controlling the orientation of the magnetic flux, it is possible to apply the same method as the bonded magnet unit 103 of the headphone driver 10.

Also, the diaphragm 207 is connected to the voice coil 205, and one end of the diaphragm 207 is connected to housing 209. The diaphragm 207 vibrates with the Lorentz force generated according to the acoustoelectric current flowed to the voice coil 205 serving as a driving force, and the acoustoelectric current is converted to sound.

In this way, by using the bonded magnet unit in which the magnetic flux is curved, it is possible to manufacture a headphone driver or a loudspeaker.

Method of Manufacturing Headphone Driver or Loudspeaker

Figure 7A:
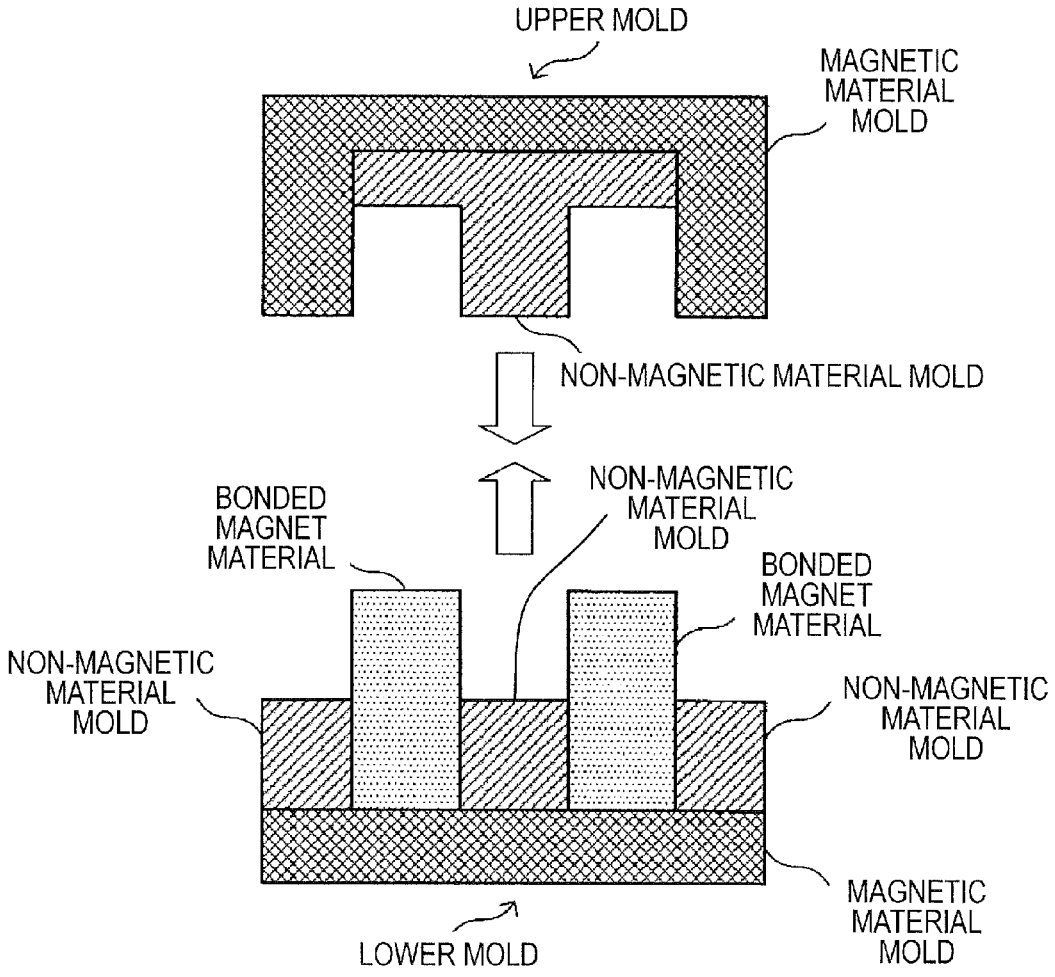
FIG. 7A is an explanatory drawing that shows an example of a mold for manufacturing the bonded magnet unit according to the same embodiment.
Figure 7B:
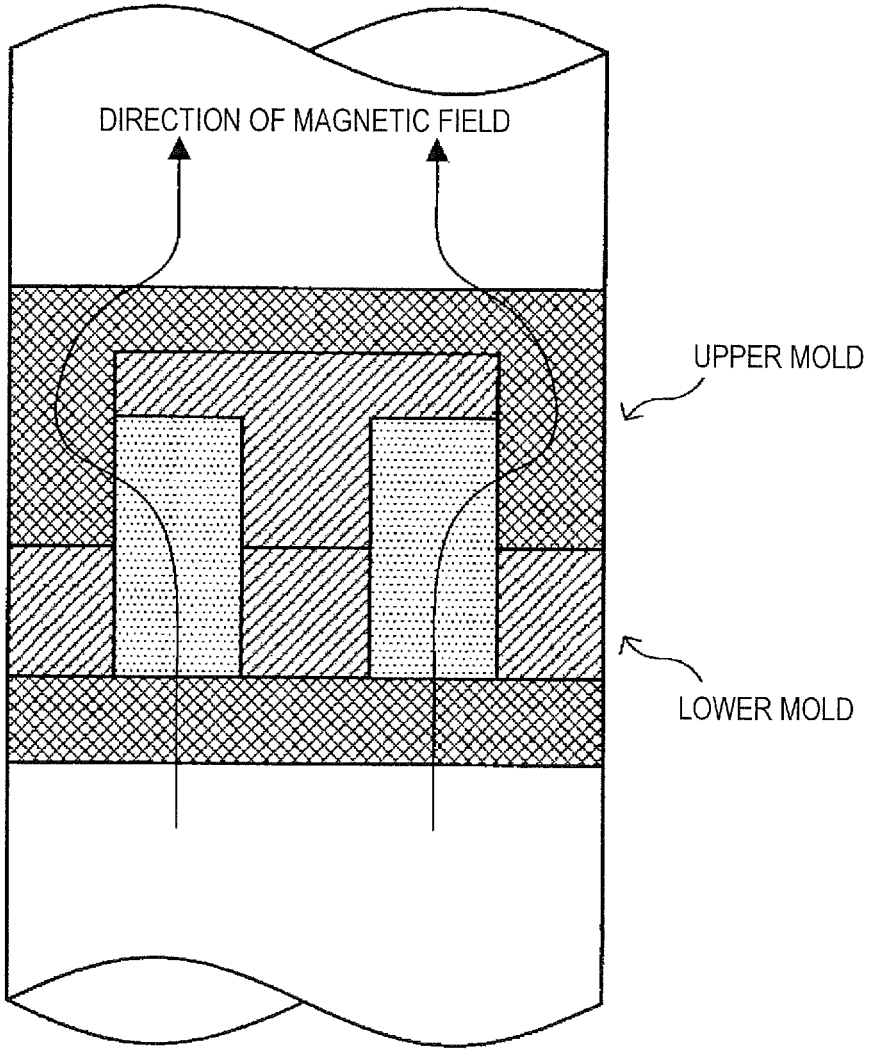
FIG. 7B is an explanatory drawing for describing a manufacturing step of the bonded magnet unit according to the same embodiment.

Next, a method of manufacturing the headphone or loudspeaker according to the present embodiment shall be described referring to FIG. 7A and FIG. 7B. FIG. 7A and FIG. 7B are explanatory drawings for describing the method of manufacturing the headphone driver or loudspeaker according to the present embodiment.

As described previously, the headphone driver and loudspeaker according to the present embodiment are provided with a bonded magnet unit that is formed using a bonded magnet in which the orientation of the magnetic flux is controlled. Accordingly, the method of manufacturing the headphone driver or loudspeaker according to the present embodiment includes a step of performing orientation control of a bonded magnet using a magnetic field molding apparatus and a mold, and manufacturing a bonded magnet unit.

More precisely, as shown in FIG. 7A, using an upper mold and a lower mold that are formed using a magnetic material and a non-magnetic material, a publicly known bonded magnet raw material is molded. In the mold that is shown in FIG. 7A, the portions corresponding to the top surface and the bottom surface of the bonded magnet unit are formed with the magnetic material. Also, of the portions corresponding to the outer side surface of the bonded magnet unit, approximately half on the top surface side in the height direction is formed with the magnetic material, and approximately half on the bottom surface side in the height direction is formed with the non-magnetic material.

The bonded magnet material raw material is sandwiched using such a mold, and the mold filled with the bonded magnet raw material is installed in a publicly known magnetic field molding apparatus. The magnitude of the magnetic field to be impressed is to be set to a publicly known value.

Since the bonded magnet raw material is one containing a magnetic material, when a magnetic field is impressed by the magnetic field molding apparatus, the magnetic flux corresponding to the impressed magnetic field becomes a loop that passes through the portions of the magnetic material, as shown in FIG. 7B. As a result, it is possible to cause the magnetic flux of the bonded magnet unit to curve in the desired shape.

By combining the bonded magnet unit manufactured in this way with a yoke, a voice coil, a diaphragm and the like manufactured by publicly known methods, it is possible to manufacture a headphone driver or a loudspeaker.

FIG. 7A and FIG. 7B illustrate a mold in the case of manufacturing a bonded magnet unit to be mounted in the headphone driver as shown in FIG. 3A, but in the case of manufacturing a bonded magnet unit to be mounted in a loudspeaker as shown in FIG. 6, the way of combining the magnetic material portions and the non-magnetic material portions in the mold should be changed to alter the mold so that the desired curvature of the magnetic flux is obtained.

Hereinabove, a method of manufacturing a headphone driver or a loudspeaker according to the present embodiment were described while referring to FIG. 7A and FIG. 7B.

Practical Embodiments

Next, the headphone driver and the loudspeaker according to the embodiment of the present disclosure shall be described in concrete terms while showing a practical embodiment. The working example shown below is only one example of the headphone driver and the loudspeaker according to the embodiment of the present disclosure, and the headphone driver and the loudspeaker according to the embodiment of the present disclosure are not necessarily limited to the following practical embodiment.

Hereinbelow, assuming an orientation-controlled bonded magnet unit having a cross-sectional shape as shown in FIG. 4A and with a magnetic powder blended at the aforementioned blending ratio, the magnitude of the magnetic flux density obtained by the bonded magnet unit was simulated with the finite element method. Also, as comparison examples, the magnetic flux density in the case of using a common neodymium sintered magnet, and the magnetic flux density of a bonded magnet unit having a cross-sectional shape as shown in FIG. 4A and using the same magnetic power without being subjected to orientation control were simulated.

Here, the width w in FIG. 4A was held constant at 3.9 mm in each of the simulation examples, and the height h was set to 4.6 mm in each of the simulation examples.

As a result, it was possible to obtain the following values of the magnetic flux density:

common neodymium sintered magnet: 759 mT bonded magnet unit not subjected to orientation control: 340 mT bonded magnet unit shown in FIG. 4A: 638 mT As is evident from the above results, by using the bonded magnet unit according to the embodiment of the present disclosure, it was found possible to realize a magnetic force nearly equivalent to a generally used sinter-molded magnet, and possible to manufacture headphones or a loudspeaker using a bonded magnet.

The preferred embodiments of the present disclosure have been described above with reference to the accompanying drawings, whilst the present invention is not limited to the above examples, of course. A person skilled in the art may find various alternations and modifications within the scope of the appended claims, and it should be understood that they will naturally come under the technical scope of the present invention.

Additionally, the present technology may also be configured as below.

(1)

A headphone driver including:

a yoke that has a bottom surface and an erected surface that is erected in a perpendicular direction with respect to the bottom surface, and that is formed using a magnetic material; and a bonded magnet unit consisting of a bonded magnet that is provided on the bottom surface of the yoke, wherein the magnetic flux of the bonded magnet unit is concentrated on the side surface of the bonded magnet unit facing the erected surface of the yoke.

(2)

The headphone driver according to (1), wherein, in the bonded magnet unit, the magnitude of the magnetic flux concentrated at the upper half portion in the height direction of the bonded magnet unit is greater than the magnitude of the magnetic flux in the lower half portion in the height direction of the bonded magnet unit positioned on a side of the bottom surface of the yoke.

(3)

The headphone driver according to (1) or (2), wherein in a cross section when the bonded magnet unit is severed in the height direction of the bonded magnet unit, the height of the bonded magnet unit is greater than one-half of the width of the bonded magnet unit.

(4)

The headphone driver according to any one of (1) to (3), wherein a projecting portion that abuts some side surface of the yoke is formed in a projecting manner at the bottom surface of the bonded magnet unit.

(5)

The headphone driver according to (4), wherein a concave portion or a through-hole is provided in the approximate center of the bottom surface of the yoke, and the projecting portion is provided at a portion corresponding to the concave portion or the through-hole of the bottom surface of the bonded magnet unit, and abuts the side surface of the concave portion or the through-hole.

(6)

A loudspeaker including:

a yoke that has a bottom surface and an erected surface that is erected in a perpendicular direction with respect to the bottom surface, and that is formed using a magnetic material; and a bonded magnet unit consisting of a bonded magnet that is provided on the bottom surface of the yoke, wherein the magnetic flux of the bonded magnet unit is concentrated on the side surface of the bonded magnet unit facing the erected surface of the yoke.

(7)

The loudspeaker according to (6), wherein, in the bonded magnet unit, the magnitude of the magnetic flux concentrated at the upper half portion in the height direction of the bonded magnet unit is greater than the magnitude of the magnetic flux in the lower half portion in the height direction of the bonded magnet unit positioned on a side of the bottom surface of the yoke.

(8)

The loudspeaker according to (6) or (7), wherein in a cross section when the bonded magnet unit is severed in the height direction of the bonded magnet unit, the height of the bonded magnet unit is greater than one-half of the width of the bonded magnet unit.

(9)

The loudspeaker according to any one of (6) to (8), wherein a projecting portion that abuts a side surface of the yoke is formed in a projecting manner at the bottom surface of the bonded magnet unit.

(10)

A method of manufacturing a headphone driver or a loudspeaker, the method including:

performing orientation control of a bonded magnet with a magnetic field molding apparatus and a mold to manufacture a bonded magnet unit, wherein portions of the mold corresponding to the top surface and the bottom surface of the bonded magnet unit are formed with a magnetic material, and among portions of the mold corresponding to the outer side surface of the bonded magnet unit, approximately half on a side of the top surface in the height direction is formed with a magnetic material, and approximately half on a side of the bottom surface in the height direction is formed with a non-magnetic material.

REFERENCE SIGNS LIST

10 headphone driver
20 loudspeaker
101, 201 yoke
103, 203 bonded magnet unit
105, 205 voice coil
107, 207 diaphragm

The invention claimed is:

1. A headphone driver comprising:

a yoke that has a bottom surface and an erected surface that is erected in a perpendicular direction with respect to the bottom surface, and that is formed using a magnetic material; and a bonded magnet unit consisting of a bonded magnet that is provided on the bottom surface of the yoke, wherein the magnetic flux of the bonded magnet unit is concentrated on a side surface of the bonded magnet unit facing the erected surface of the yoke, and wherein, in a cross section in a height direction of the bonded magnet unit, a height of the bonded magnet unit is greater than one-half of a width of the bonded magnet unit.

2. The headphone driver according to claim 1, wherein, in the bonded magnet unit, the magnitude of the magnetic flux concentrated at the upper half portion in the height direction of the bonded magnet unit is greater than the magnitude of the magnetic flux in the lower half portion in the height direction of the bonded magnet unit positioned on a side of the bottom surface of the yoke.

3. The headphone driver according to claim 2, wherein a projecting portion that abuts some side surface of the yoke is formed in a projecting manner at the bottom surface of the bonded magnet unit.

4. The headphone driver according to claim 3, wherein a concave portion or a through-hole is provided in the approximate center of the bottom surface of the yoke, and the projecting portion is provided at a portion corresponding to the concave portion or the through-hole of the bottom surface of the bonded magnet unit, and abuts the side surface of the concave portion or the through-hole.

5. The headphone driver according to claim 1, wherein the magnetic flux of the bonded magnet unit is concentrated at a portion facing a voice coil that is positioned between the yoke and the bonded magnet.

6. A loudspeaker comprising:

a yoke that has a bottom surface and an erected surface that is erected in a perpendicular direction with respect to the bottom surface, and that is formed using a magnetic material; and a bonded magnet unit consisting of a bonded magnet that is provided on the bottom surface of the yoke, wherein the magnetic flux of the bonded magnet unit is concentrated on a side surface of the bonded magnet unit facing the erected surface of the yoke, and wherein, in a cross section in a height direction of the bonded magnet unit, a height of the bonded magnet unit is greater than one-half of a width of the bonded magnet unit.

7. The loudspeaker according to claim 6, wherein, in the bonded magnet unit, the magnitude of the magnetic flux concentrated at the upper half portion in the height direction of the bonded magnet unit is greater than the magnitude of the magnetic flux in the lower half portion in the height direction of the bonded magnet unit positioned on a side of the bottom surface of the yoke.

8. The loudspeaker according to claim 7, wherein a projecting portion that abuts a side surface of the yoke is formed in a projecting manner at the bottom surface of the bonded magnet unit.

9. The loudspeaker according to claim 6, wherein the magnetic flux of the bonded magnet unit is concentrated at a portion facing a voice coil that is positioned between the yoke and the bonded magnet.

* * * * *